US008342511B2

(12) United States Patent
Takahashi

(10) Patent No.: US 8,342,511 B2
(45) Date of Patent: Jan. 1, 2013

(54) SHEET FEEDING DEVICE AND IMAGE FORMING APPARATUS

(75) Inventor: Kakeru Takahashi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/316,799

(22) Filed: Dec. 12, 2011

(65) Prior Publication Data

US 2012/0153558 A1 Jun. 21, 2012

(30) Foreign Application Priority Data

Dec. 17, 2010 (JP) ..... 2010-281478

(51) Int. Cl.
*B65H 3/52* (2006.01)

(52) U.S. Cl. ..... 271/124; 271/125

(58) Field of Classification Search ..... 271/122, 271/124, 125
See application file for complete search history.

(56) References Cited

U.S. PATENT DOCUMENTS

| | | | | |
|---|---|---|---|---|
| 4,796,035 | A | 1/1989 | Kawasaki et al. | |
| 5,039,080 | A * | 8/1991 | Kato et al. | 271/122 |
| 5,290,024 | A | 3/1994 | Takahashi | |
| 5,474,287 | A | 12/1995 | Takahashi | |
| 5,564,689 | A * | 10/1996 | Fukube | 271/122 |
| 5,909,872 | A | 6/1999 | Takahashi | |
| 6,120,018 | A * | 9/2000 | Amano | 271/121 |
| 6,311,039 | B1 | 10/2001 | Funamizu et al. | |
| 6,397,035 | B2 | 5/2002 | Kataoka et al. | |
| 6,467,767 | B2 * | 10/2002 | Yano | 271/122 |
| 7,591,460 | B2 * | 9/2009 | Ohshima et al. | 271/125 |
| 7,896,342 | B2 * | 3/2011 | Tsukamoto et al. | 271/265.04 |
| 2001/0020765 | A1 * | 9/2001 | Araki et al. | 271/125 |
| 2002/0074712 | A1 * | 6/2002 | Yano | 271/121 |
| 2004/0188919 | A1 * | 9/2004 | Sakamaki et al. | 271/122 |
| 2006/0180990 | A1 * | 8/2006 | Ueda et al. | 271/121 |
| 2007/0257418 | A1 * | 11/2007 | Tsukamoto et al. | 271/110 |
| 2008/0099296 | A1 * | 5/2008 | Sheng | 192/54.1 |
| 2009/0295071 | A1 | 12/2009 | Takahashi et al. | |
| 2010/0117289 | A1 | 5/2010 | Takahashi et al. | |

FOREIGN PATENT DOCUMENTS

| | | |
|---|---|---|
| JP | 2002-002992 | 1/2002 |
| JP | 2003-301857 | 10/2003 |

* cited by examiner

*Primary Examiner* — David H Bollinger
(74) *Attorney, Agent, or Firm* — Fitzpatrick, Cella, Harper & Scinto

(57) ABSTRACT

Disclosed is a sheet feeding device capable of prolonging the durability life span of the retard roller with a simple structure with ease and an image forming apparatus which includes the sheet feeding device. The sheet feeding device includes a feed roller 102 which rotates in a sheet feed direction, a retard roller 103 which is able to rotate in a reverse direction to the sheet feed direction which forms a separation nip portion. A torque limiter 202 which is interposed between a drive shaft 202*b* and a roller shaft 103*b* of the retard roller 103 to transfer a predetermined torque of the reverse direction to the retard roller 103; and a speed changing device 301 which is interposed between an output shaft 202*a* of the torque limiter 202 and the roller shaft 103*b* to change a magnitude of the predetermined torque transferred to the retard roller 103.

8 Claims, 5 Drawing Sheets

SHEET FEEDING DEVICE AND IMAGE FORMING APPARATUS

BACKGROUND OF THE INVENTION

1. Field of the Invention

The present invention relates to a sheet feeding device and an image forming apparatus, and more particularly to a sheet feeding device which feeds sheets while separating the sheets one by one and an image forming apparatus including the sheet feeding device.

2. Description of the Related Art

In the related art, an image forming apparatus, such as a printer, a copying machine, or a facsimile is equipped with a sheet feeding device which sends a sheet from a sheet stacking portion using a pick-up roller and which separates the sheets one by one using a separation portion and then feeds the separated sheets in a case where multiple sheets are fed.

The separation portion provided in the sheet feeding device is categorized as a roller type which uses a feed roller and a retard roller capable of reverse rotation or a friction separation type which uses a separating member such as a separation roller or a separation pad.

For example, the roller-type sheet feeding device includes a feed roller which rotates in synchronization with a pick-up roller in the same direction and a retard roller which is pressed by the feed roller with a sheet conveying path therebetween. A predetermined torque in an opposite direction to the sheet feed direction is exerted on the retard roller through a torque limiter. Accordingly when a predetermined torque is applied to the retard roller due to the double feed of sheets, the retard roller rotates in the opposition direction to the sheet feed direction, so that the sheets double fed are separated one by one. Accordingly, in a case where, for example, a sponge roller is used for the retard roller, the collapse amount of the retard roller increases over use and the increased collapse amount results in a resisting force against the rotation, thereby impeding the retard roller's rotation (hereinafter, referred to as "co-rotation") along with the feed roller. This gives rise to the co-rotation failure of the retard roller. The co-rotation failure of the retard roller impedes the feeding of the sheet into a nip portion between the feed roller and the retard roller, which is likely to cause a paper jam.

In particular, when the load resistance of the retard roller for separating sheets is heavy and the retard roller is a sponge roller, the problem with that retard roller is a significantly short durability life span compared with general conveying rollers. Furthermore, in recent years, with the increase in the amount of information, image forming apparatuses such as copying machines are in ever more increasing use. Accordingly, it is required to prolong the durability life span of the retard roller.

Meanwhile, since an increase in the collapse amount of the retard roller leads to a higher resisting force against the co-rotation of the retard roller, sheets which are double-fed can be separated. For such a reason, the rotary torque transferred to the retard roller can be reduced according to a durability status such as the number of conveyed sheets or the collapse amount of the sponge retard roller, the sheets may be properly separated and thus co-rotation failure can be suppressed. That is, it is believed that the durability life span of the retard roller can be prolonged by delaying the occurrence of the co-rotation failure as much as possible.

In this regard, there are more known sheet feeding devices. For example, Japanese Patent Laid-Open (JP-A) No. 2002-2992 discloses a sheet feeding device which reduces the rotary torque transferred to a retard roller using a plurality of torque limiters and JP-A No. 2003-301857 discloses a sheet feeding device which reduces the rotary torque by modifying the internal structure of a torque limiter.

However, those sheet feeding devices have the following problems. That is, in the case of using a plurality torque limiters as in the sheet feeding device disclosed in JP-A No. 2002-2992, the cost of the sheet feeding device increases. On the other hand, in the case of reducing the rotary torque with the modified internal structure of the torque limiter as in the sheet feeding device disclosed in JP-A No. 2003-301857, a highly precise and accurate calibration is required for the torque limiter.

Accordingly, the present invention provides a sheet feeding device capable of prolonging the durability life span of a retard roller using a simple structure with ease and an image forming apparatus which includes the sheet feeding device.

SUMMARY OF THE INVENTION

A sheet feeding device includes a feed roller which rotates in a sheet feed direction, a separation roller which is able to rotate in a reverse direction to the sheet feed direction, which is configured to separate sheets one by one between the feed roller and the separation roller, a torque limiter which is interposed between a drive shaft driven to rotate by a drive source and a roller shaft of the separation roller to transfer a predetermined torque of the reverse direction to the separation roller, and a torque changing unit which is interposed between an output shaft of the torque limiter and the roller shaft of the separation roller to change the magnitude of a torque transferred to the separation roller.

According to the invention, it is possible to prolong the durability life span of the retard roller using a simple structure with ease by employing a torque changing unit which changes a rotary torque exerted on the retard roller.

Further features of the present invention will become apparent from the following description of exemplary embodiments with reference to the attached drawings.

DESCRIPTION OF THE EMBODIMENTS

Hereinbelow, an image forming apparatus including a sheet feeding portion serving as a sheet feeding device according to embodiments of the present invention will be described with reference to the accompanying drawings. The image forming apparatus according to the present embodiment is a copying machine, a printer, a facsimile, a multifunction peripheral which is a combination of those machines, or the like, and it includes a sheet feeding portion which feeds sheets stacked on a sheet staking unit.

<First Embodiment>

Figure 1:
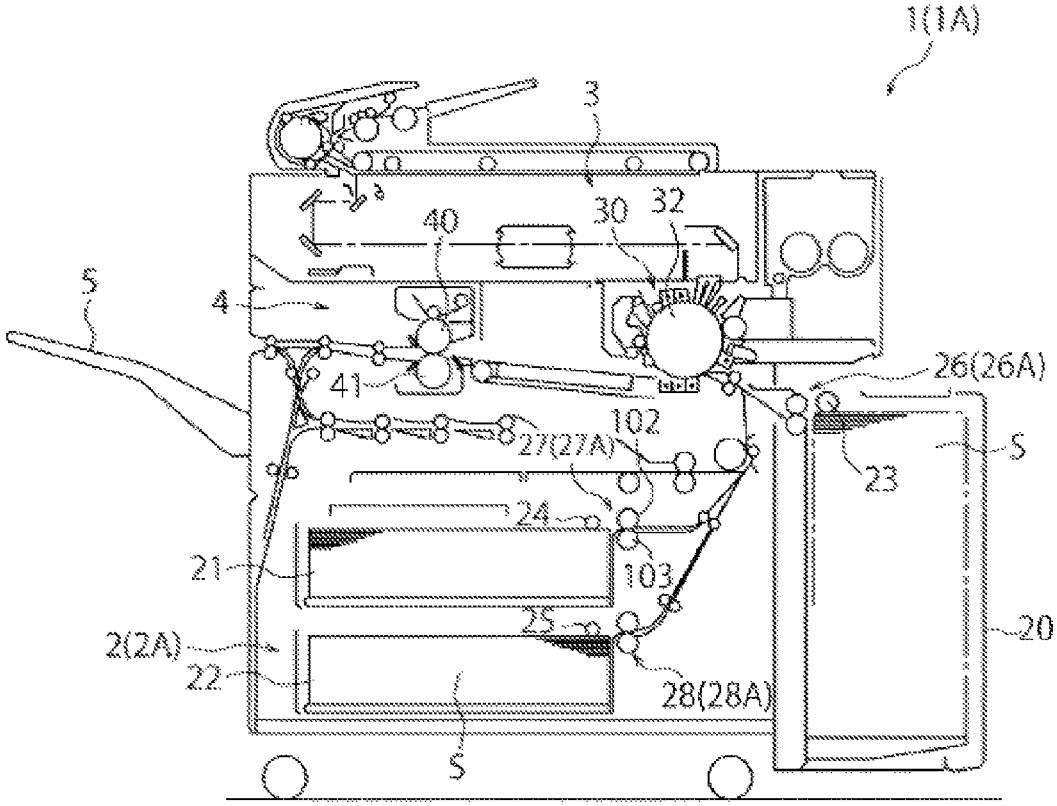
FIG. 1 is a cross-sectional view illustrating the overall structure of an image forming apparatus according to a first embodiment of the present invention.

An image forming apparatus 1 according to a first embodiment of the present invention will be described with reference to the drawings. The overall structure of the image forming apparatus 1 according to the first embodiment will be described first with reference to FIG. 1. FIG. 1 is a cross-sectional view illustrating the overall structure of the image forming apparatus according to an embodiment of the present invention.

As illustrated in FIG. 1, the image forming apparatus 1 includes a sheet feeding portion 2 which feeds a sheet S, an image forming portion 3 which forms an image on the sheet S, a fixing portion 4 which fixes the image formed on the sheet S, and a discharging portion 5 which discharges the sheet S.

The sheet feeding portion 2 includes a sheet deck 20, a plurality of universal cassettes 21 and 22, pick-up rollers 23, 24, and 25, separation portions 26, 27, and 28, a pair of pulling-out rollers (not illustrated), and a pair of registration rollers (not illustrated).

The sheet deck 20 is disposed at a side portion of the image forming apparatus 1 and stores a large number of sheets S in a stacked state. The universal cassettes 21 and 22 are provided at a lower portion of the image forming apparatus 1 and store a predetermined number of sheets S in a stacked state. In each of the sheet deck 20 and the universal cassettes 21 and 22, a lifter (not illustrated) is provided to be able to be lifted and lowered. The sheets S are stacked and stored on the lifter.

The pick-up rollers 23, 24, and 25 are arrayed above the sheets S stored in the sheet deck 20 and the plurality of universal cassettes 21 and 22 in a stacked state and sequentially sends the sheets S from the sheet deck 20 and the plurality of universal cassettes 21 and 22. The pick-up rollers 23, 24, and 25 abut on the top surfaces of the stacks of the sheets S stored in a stacked state in the sheet deck 20 and the plurality of universal cassettes 21 and 22 while pressing the top surfaces with a predetermined pressing force by the action of a lifting and lowering unit (not illustrated). Furthermore, the pick-up rollers 23, 24, and 25 are able to move away from the sheets S.

The separation portions 26, 27, and 28 are provided on the downstream side of the pick-up rollers 23, 24, and 25 in the sheet feed direction, and separate the sheets S fed by the pick-up rollers 23, 24, and 25 one by one. The pair of pulling-out rollers is provided on the downstream side of the separation portions 26, 27, and 28 in the sheet feed direction. The pair of pulling-out rollers pulls out the sheets S one after another separated by the separation portions 26, 27, and 28 and convey the sheet S into the pair of registration rollers. The pair of registration rollers conveys the sheet S pulled out by the pair of pulling-out rollers to the image forming portion 3 at a predetermined timing.

The image forming portion 3 forms an image based on predetermined image information on the sheet S which is pulled out by the pair of pulling-out rollers and conveyed by the pair of registration rollers at a predetermined timing. The image forming portion 3 includes a process cartridge 30, and a transfer roller (not illustrated) which is disposed to face the process cartridge 30. The process cartridge 30 includes a photosensitive drum 32 as an image bearing member, a charging portion (not illustrated), an exposing portion (not illustrated), a developing portion (not illustrated), and a cleaning portion (not illustrated).

The photosensitive drum 32 is configured in the form of a metallic circular cylinder with a negatively charged photosensitive layer on its surface. The charging portion uniformly charges the surface of the photosensitive drum 32 serving as an image bearing member. The exposing portion irradiates a laser beam based on image information to form an electrostatic latent image on the surface of the photosensitive drum 32. The developing portion attaches toner to the electrostatic latent image formed on the surface of the photosensitive drum 32 to visualize the electrostatic latent image into a toner image. The transfer roller 31 is disposed to face the photosensitive drum 32 and transfers the toner image formed on the surface of the photosensitive drum 32 to the sheet P. The cleaning portion removes the toner remaining on the surface of the photosensitive drum 32.

The fixing portion 4 is disposed on the downstream side of the image forming portion 3 and includes a heating roller 40 which heats a sheet S and a pressing roller 41 which presses the sheet S. The fixing portion 4 fixes the toner image transferred to the sheet S by the actions of heat and pressure applied by heating roller 40 and the pressing roller 41, respectively.

Next, the separation portions 26, 27, and 28 mounted in the sheet feeding portion 2 according to the first embodiment will be described in greater detail with reference to FIGS. 2A and 2B as well as FIG. 1.

Figures 2A, 2B:
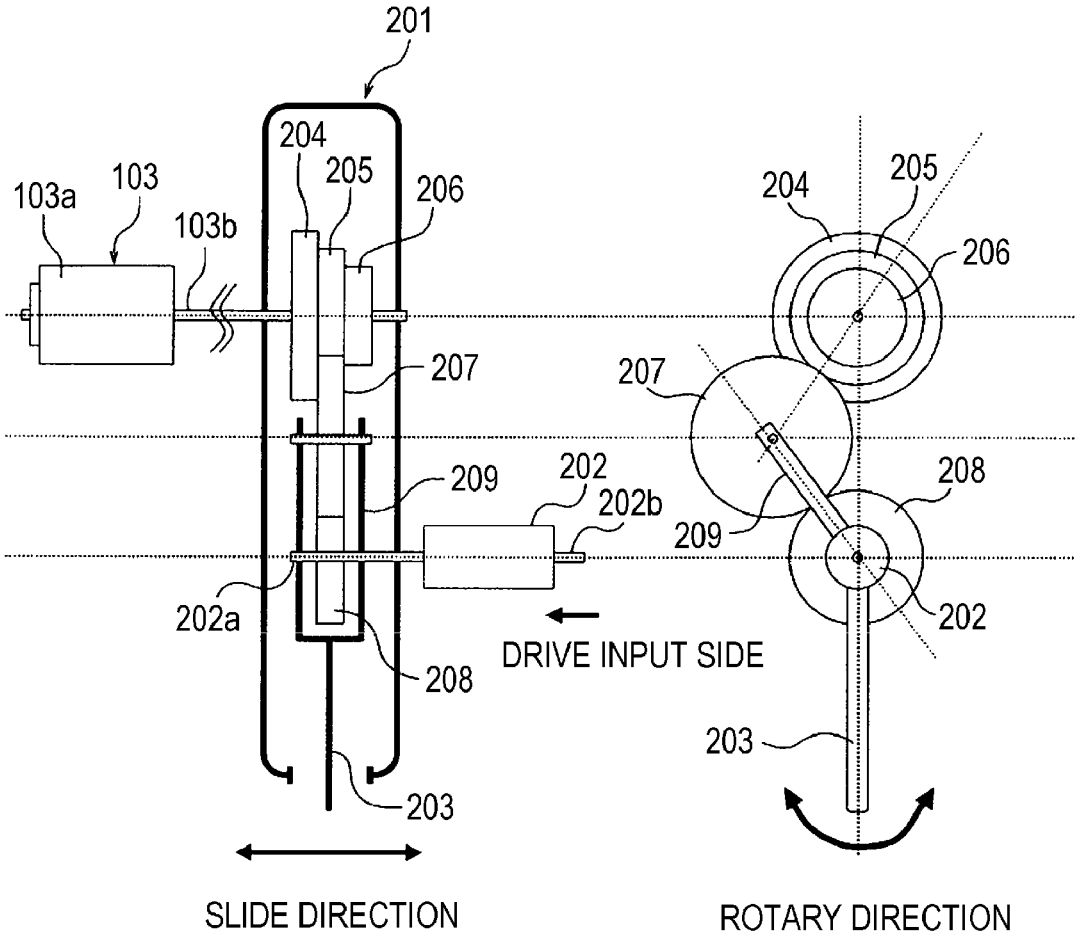
FIG. 2A is a plan view illustrating a retard roller, a torque limiter, and a speed changing device according to the first embodiment
FIG. 2B is a side view illustrating the structure of FIG. 2A.

FIG. 2A is a plan view illustrating the retard roller 103, a torque limiter 202, and a speed changing device 201 according to the first embodiment. FIG. 2B is a side view illustrating the structure of FIG. 2A.

The separation portions 26, 27, and 28 according to the first embodiment are configured to be able to completely change a rotary torque, which is transmitted to the retard roller 103 through the torque limiter 202 from a drive source (not illustrated), through an operation of the operation handle by an operator such as a service person. Since the separation portions 26, 27, and 28 have the same structure, a description will be made only about the separation portion 27 disposed on the downstream side, in the sheet feed direction, of the pick-up roller 24 which sends the sheet S of the universal cassettes 21 one after another.

As illustrated in FIGS. 1 and 2A, the separation portion 27 includes a feed roller 102 serving as a sheet feed roller, a retard roller 103 serving as a separation roller, a torque limiter 202, and a speed changing device 201 serving as a torque changing unit.

The feed roller 102 is disposed on the downstream side of the pick-up roller 24 and is connected with the pick-up roller 24 through a gear (not illustrated). Since the feed roller 102 is connected with the pick-up roller 24 through the gear (not illustrated), it rotates in the sheet feed direction in synchronization with the pick-up roller 24.

The retard roller 103 is able to rotate in both the sheet feed direction and a "reverse direction which is opposite to the sheet feed direction" (hereinafter, referred to as "reverse feed direction"). The retard roller 103 is pressed by the feed roller 102 with the sheet feed path therebetween, along which the sheet S feeds. In a manner that the retard roller 103 is pressed by the feed roller 102, a separation nip is formed between the retard roller 103 and the feed roller 102 so as to separate the sheets S one by one. The retard roller 103 can rotate along with the feed roller 102 in synchronization with the pick-up roller 24 while being pressed by the feed roller 102. This rotation manner of the retard roller 103 is hereinafter called "co-rotation".

The retard roller 103 includes a roller body 103*a* which forms a separation nip portion by cooperating with the feed roller 102, and a roller shaft 103*b* which supports the roller body 103*a* so as to be able to freely rotate. Concerning the retard roller 103, a rotary torque as a predetermined torque is transferred from a drive source in the reverse feed direction to the retard roller 103 through the torque limiter 202, so that the retard roller 103 is rotated in the reverse feed direction. In consequence, the sheets S are separated one by one by the separation nip portion when the sheets are double-fed.

As illustrated in FIG. 2A, the torque limiter 202 is disposed (interposed) between a drive shaft 202*b* which is driven to rotate by the drive source and a roller shaft 103*b* of the retard roller 103. The torque limiter 202 includes an output shaft 202*a* which transfers the rotary torque, which is transferred from the drive shaft 202*b*, to the speed changing device 201. The output shaft 202*a* is disposed to be parallel to the roller shaft 103*b*.

The speed changing device 201 is disposed (interposed) between the output shaft 202*a* of the torque limiter 202 and the roller shaft 103*b* of the retard roller 103, so that it transfers the rotary torque transferred from the drive source to the retard roller 103 through the torque limiter 202. The speed changing device 201 includes a first gear 204, a second gear 205, and a third gear 206, which are a plurality of driven gears attached to the roller shaft 103*b*, and a fourth gear 208 which is a drive gear attached to the output shaft 202*a*. The speed changing device 201 includes a fifth gear 207 as an intermediate gear which interlocks any one selected gear out of the first gear 204, the second gear 205, and the third gear 206 with the fourth gear 208. The speed changing device 201 includes an operation arm 209 which supports the fifth gear 207 so as to be able to freely rotate, and an operation handle 203 which is connected to the operation arm 209.

The first gear 204 meshes with the fourth gear 208 with a gear ratio of 1:1, and the first gear 204 and the fourth gear 208 have the same diameter. The second gear 205 meshes with the fourth gear 208 with a gear ratio of 0.95 (second gear):1 (fourth gear). That is, the second gear 205 has a smaller number of teeth than the first gear 204 which has the same diameter as the fourth gear 208, and has a smaller diameter than the first gear 204. The gear ratio of the third gear 206 which meshes with the fourth gear 208 is 1 (fourth gear): 0.875 (third gear). That is, the third gear 206 has a smaller number of teeth and a smaller diameter than the second gear 205.

The operation arm 209 and the operation handle 203 are connected to each other through the rotary shaft of the fourth gear 208. The operation handle 203 is able to freely rotate about the rotary shaft of the fourth gear 208. The operation arm 209 is connected with the operation handle 203 at its base portion and supports the fifth gear 207 at its leading end portion. In the operation arm 209, when the operation handle 203 is turned, the fifth gear 207 is locked. The fifth gear 207 meshes with the fourth gear 208. The fifth gear 207 is configured to mesh with any one of the first gear 204, the second gear 205, and the third gear 206 when the operation handle 203 is operated (turned or slid as in FIGS. 2A and 2B). That is, in a way of operating the operation handle 203, any one of the first gear 204, the second gear 205, and the third gear 206 is enabled to be interlocked with the fourth gear 208 via the fifth gear 207.

Next, the operation that the separation portion 27 separates the sheets S will be described. The sheet S which is sent out of the universal cassette 21 by the pick-up roller 24 is fed into the separation nip portion configured by the feed roller 102 which rotates in synchronization with the pick-up roller 24 and the retard roller 103. The sheet S which is fed into the separation nip portion is nipped in the separation nip portion, and fed further downstream by the operation that the retard roller 103 rotates along with the feed roller 102.

On the other hand, in a case where the sheets S are double-fed, if the sheets S are nipped in the separation nip portion, the frictional force between sheets is small. Accordingly, the retard roller 103 does not rotate along with the feed roller 102, but rotates in the reverse feed direction due to the rotary torque transferred from the drive source. When the retard roller 103 rotates in the reverse feed direction, the sheet S which abuts on the retard roller 103 is conveyed in the reverse feed direction by the retard roller, so that only the sheet S which abuts on the feed roller 102 is fed in the sheet feed direction. In this way, the sheets S which are double-fed are separated one by one and fed forward.

The sheet S, fed forward by the separation nip portion, is pulled out by the pulling-out rollers and then conveyed to the image forming portion 3 by the registration rollers at predetermined timing. After that, an image is formed on the sheet S which is conveyed to the image forming portion 3, based on predetermined image information. Next, the image is fixed onto the sheet S by the fixing portion 4. The sheet S to which the image is fixed is discharged to a discharging portion 5 and an image forming process ends.

In the image forming apparatus having the structure described above, when the retard roller 103 includes a sponge roller body 103*a*, a portion of the roller body 103*a* collapses over a long period of use or the like. That is, the collapse amount increases. If the collapse amount of the roller body 103*a* increases, a resisting force against the rotation of the retard roller 103 is generated, so that the co-rotation of the retard roller 103 and the feed roller 102 is hindered, for example. That is, the retard roller 103 is likely to experience a co-rotation failure.

A co-rotation failure of the retard roller 103 impedes the feeding of the sheet S into the separation nip portion, thereby causing a paper jam. In the related art, the retard roller 103 is replaced when a paper jam occurs due to the co-rotation failure. That is, concerning the retard roller 103, the durability life span ends with the occurrence of a paper jam, so that it is replaced by an operator such as a service person at that time.

The speed changing device 201 according to the first embodiment of the invention changes the rotary torque transferred to the retard roller 103 before the occurrence of the paper jam attributable to the co-rotation failure of the retard roller 103, thereby prolonging the durability life span of the retard roller 103.

Specifically, as illustrated in FIGS. 2A and 2B, the first to third gears 204, 205, and 206 are attached to the roller shaft 103*b* of the retard roller 103, and the fourth gear 208 is attached to the output shaft 202*a* of the torque limiter 202. As to the linkage of the first to third gears 204, 205, and 206 with the fourth gear 208, any one of the first to third gears 204, 205, and 206 can be selectively interlocked with the fourth gear 208 by operating the fifth gear 207 using the operation handle 203. That is, the speed change ratio of the retard roller 103 is changed in multiple stages based on the gear selected from the first to third gears 204, 205, and 206, and that change in the speed change ratio brings the change in the rotary torque.

The speed change ratio is changed by an operator such as a user, but, for example, it is changed according to the number of conveyed sheets. Under initial conditions (for example, in a state in which the retard roller 103 is a new product which has been replaced shortly before), since the collapse amount of the retard roller 103 is small, it is not necessary to change the gear so as to turn in a direction to reduce the magnitude of the rotary torque. Accordingly, under the initial conditions, the fifth gear 207 is in mesh in a manner of interlocking the first gear 204 with the fourth gear 208.

However, at the time, for example, when the number of conveyed sheets reaches 50,000, the collapse amount of the retard roller 103 increases. Accordingly, when an operator checks up on the conveyance of sheets and finds that the number of conveyed sheets reaches 50,000, the operator operates the operation handle 203 to bring the mesh of the fifth gear 207 which enables the second gear 205 to be interlocked with the fourth gear 208. In this way, the change gear ratio between the output shaft 202*a* of the torque limiter 202 and the roller shaft 103*b* of the retard roller 103 can be changed. That is, by selecting the second gear 205 having a smaller number of teeth than the first gear 204, the roller shaft 103*b* decelerates and thus the rotary torque is reduced. For example, in a case where the rotary torque transferred to the retard roller 103 is 400 (gf·cm) under the initial conditions, after the conveyance of 50,000 sheets, the second gear 205 is brought into mesh with the fourth gear 208 through the fifth gear 207, so that the rotary torque transferred to the retard roller 103 becomes 380 (gf·cm).

Next, once 100,000 sheets, for example, are conveyed, the collapse amount of the retard roller 103 increases again. In this case, when an operator checks up and confirms the conveyance of 100,000 sheets, the operator would operate the operation handle 203 to switch the fifth gear 207's mesh, so that the third gear 206 and the fourth gear 208 would be interlocked. In this way, the change gear ratio between the output shaft 202*a* of the torque limiter 202 and the roller shaft 103*b* of the retard roller 103 can be changed. That is, by selecting the third gear 206 having a smaller number of gear teeth than the second gear 205, the roller shaft 103*b* decelerates and thus the rotary torque is reduced. For example, in a case where the rotary torque transferred to the retard roller 103 is 380 (gf·cm) for the conveyance of up to 50,000 sheets, the second gear 205 is brought into mesh with the fourth gear 208 through the fifth gear 207 for the conveyance of up to 100,000 sheets, so that the rotary torque transferred to the retard roller 103 becomes 350 (gf·cm).

In a case where the rotary torque transferred to the retard roller 103 is in the range of 370 to 430 (gf·cm), an appropriate range of the rotary torque is 350 to 410 (gf·cm) after the conveyance of 50,000 sheets, and an appropriate range of the rotary torque is 325 to 375 (gf·cm) after the conveyance of 100,000 sheets. Accordingly, the rotary torque can be adjusted to be kept within the appropriate range by changing the change gear ratio as described above. The change in the change gear ratio brings the change in the return speed of the retard roller 103. However, if the teeth number ratio is kept within the above-described range, the change of the return speed does not nearly affect the returnability of the retard roller 103.

The image forming apparatus 1 which includes the sheet feeding portion 2 having the above-described structure according to the first embodiment demonstrates the following effects. The sheet feeding portion 2 according to the first embodiment includes the speed changing device 201 which is able to change the rotary torque transferred to the retard roller 103. For such a reason, for example, it is possible to change the rotary torque transferred to the retard roller 103 with a simple structure, without increasing the number of torque limiters used. Accordingly, even after a long period of use of the retard roller 103, since the speed changing device 201 changes the rotary torque, it is possible to prevent co-rotation failure from occurring in a short time. As a result, the replacement cycle of the retard roller 103 increases and thus the durability life span of the retard roller 103 is prolonged.

The change of the rotary torque can be achieved by changing the interlocking between any gear selected from the first to third gears 204, 205, and 206 attached to the roller shaft 103*b* with the fourth gear 208 attached to the output shaft 202*a* in multiple stages. Accordingly, the change in the rotary torque can be achieved with a simple structure.

The rotary torque can be changed in such a manner that an operator such as a service person or a user operates the operation handle 203 connected to the operation arm 209 which supports the fifth gear 207.

Accordingly, the rotary torque change can be achieved by a simple operation.

<Second Embodiment>

Figure 3A:
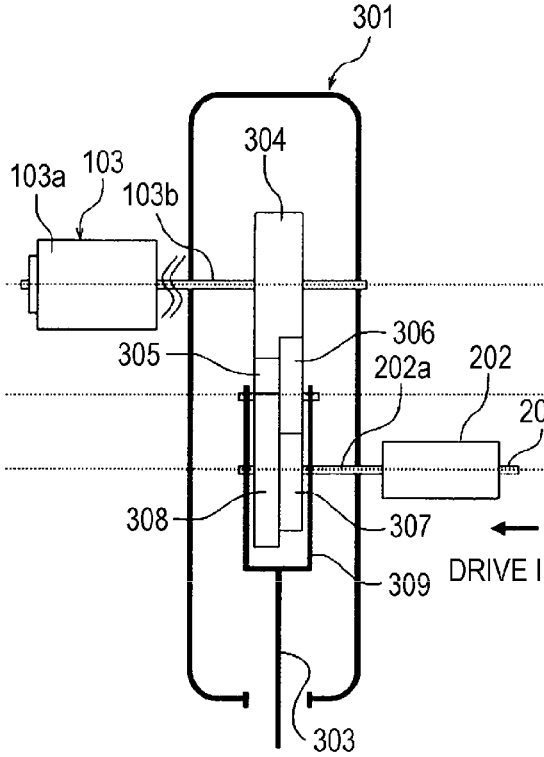
FIG. 3A is a plan view illustrating a retard roller, a torque limiter, and a speed changing device according to a second embodiment
Figure 3B:
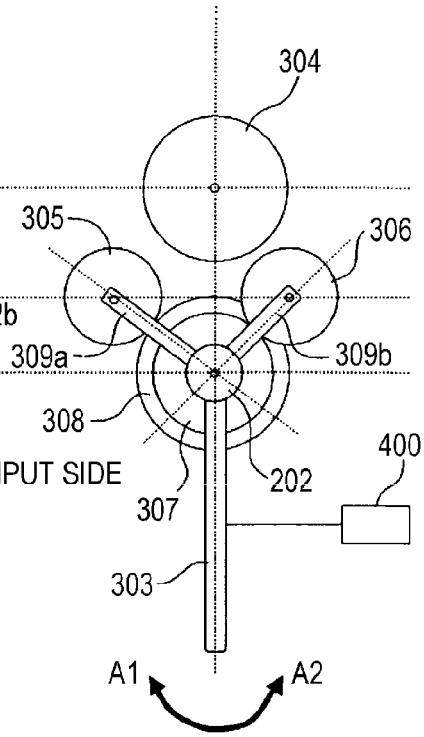
FIG. 3B is a side view illustrating the structure of FIG. 3A.
Figure 4:
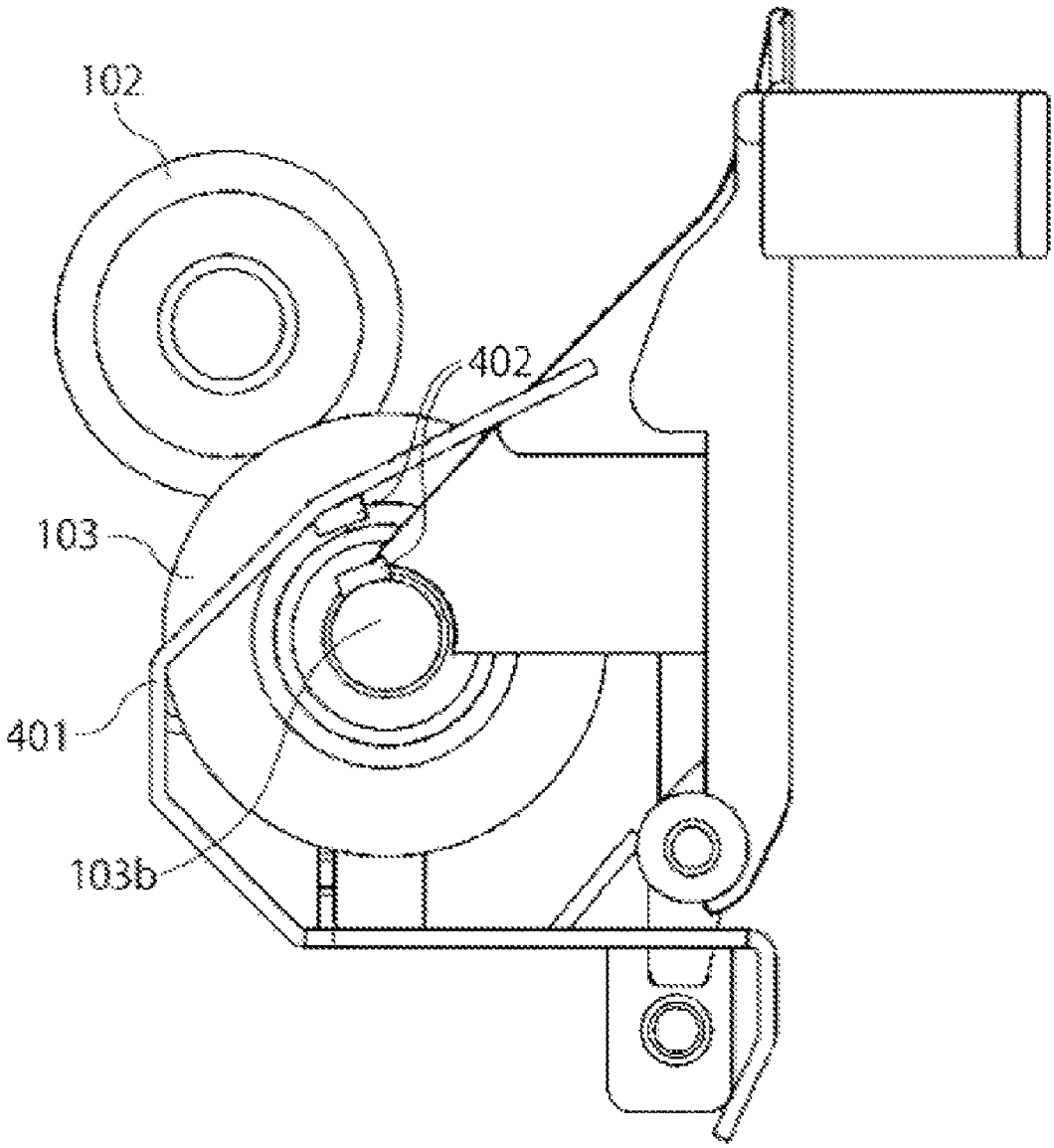
FIG. 4 is a diagram illustrating a detection sensor which detects a collapse amount of the retard roller according to the second embodiment.

Next, an image forming apparatus 1A according to a second embodiment of the present invention is described with reference to FIGS. 3A, 3B, 4, and 5 in addition to FIG. 1. FIG. 3A is a plan view illustrating a retard roller 103, a torque limiter 302, and a speed changing device 301 according to the second embodiment. FIG. 3B is a side view illustrating the structure of FIG. 3A. FIG. 4 is a diagram illustrating a detection sensor 402 which detects a collapse amount of a retard roller 103 according to the second embodiment.

The image forming apparatus 1A according to the second embodiment differs from the first embodiment in terms of separation portions 26A, 27A, and 28A provided in a sheet feeding portion 2A. Specifically, the separation portions 26A, 27A, and 28A include a detection sensor 402 serving as a detection portion. Based on the detection result from the detection sensor 402, an actuator 400 serving as an operation unit operates an operation handle 303. That is, the operation handle 303 is operated by the actuator 400 based on the detection result from the detection sensor 402, the rotary torque can be changed. The second embodiment will be described focusing on the points that discriminate the second embodiment from the first embodiment, that is, focusing on the separation portions 26A, 27A, and 28A.

In describing the second embodiment, concerning components having the same structure as those of the image forming apparatus 1 according to the first embodiment, reference will be made to FIG. 1 and those components will be denoted by the same reference symbols as in FIG. 1 and will not be redundantly described. In the second embodiment, the components having the same structure as those in the first embodiment demonstrate the same effects as in the first embodiment.

As illustrated in FIG. 1, the image forming apparatus 1A according to the second embodiment includes the sheet feeding portion 2A which feeds a sheet S, an image forming portion 3 which forms an image on the sheet S, a fixing portion 4 which fixes the image formed on the sheet S, and a discharging portion 5 which discharges the sheet S to which the image is fixed.

The sheet feeding portion 2A includes: a sheet deck 20; a plurality of universal cassettes 21 and 22; pick-up rollers 23, 24, and 25; separation portions 26A, 27A, and 28A; a pair of pulling-out rollers (not illustrated); and a pair of registration rollers (not illustrated). The separation portions 26A, 27A, and 28A are disposed on the downstream side of the pick-up rollers 23, 24, and 25 in the sheet feed direction to separate the sheets S fed by the pick-up rollers 23, 24, and 25 one by one.

Next, the separation portions 26A, 27A, 28A provided in the sheet feeding portion 2A according to the second embodiment will be described in detail. Since the separation portions 26A, 27A, and 28A have the same structure, a description will be made only about the separation portion 27A arranged on the downstream side, in the sheet feed direction, of the pick-up roller 24 which sequentially fetches and sends out the sheets S from the universal cassette 21.

As illustrated in FIGS. 3A and 3B, the separation portion 27A includes a feed roller 102, the retard roller 103, the torque limiter 202, the speed changing device 301 serving as a torque changing unit, an actuator 400 serving as an operation unit, and a detection sensor 402.

The speed changing device 301 is disposed between an output shaft 202*a* of the torque limiter 202 and a roller shaft 103*b* of the retard roller 103 to transfer the rotary torque, which is transmitted from a drive source, to the retard roller 103 through the torque limiter 202. The speed changing device 301 includes: a sixth gear 304 attached to the roller shaft 103*b*; a seventh gear 307 and an eighth gear 308 attached to the output shaft 202*a*; and ninth gears 305 and 306 which enable the sixth gear 304 to mesh with the seventh gear 307 or the eighth gear 308. The speed changing device 301 includes the operation arms 309*a* and 309*b* which support the ninth gears 305 and 306 so as to be able to freely rotate, and further includes an operation handle 303 connected to the operation arms 209*a* and 309*b*.

The seventh gear 307 meshes with the sixth gear 304 with a teeth number ratio of 1:1. The seventh gear 307 and the sixth gear 306 have the same diameter. The eighth gear 308 meshes with the sixth gear 306 with a teeth number ratio of 1.1 (the eighth gear):1.0 (the sixth gear). That is, the eighth gear 308 has a larger number of teeth than the seven gear 307 which has the same diameter as the sixth gear 306. The eighth gear 308 has a larger diameter than the seventh gear 307.

The ninth gear 305 and the ninth gear 306 have the same number of teeth and the same diameter. The ninth gear 305 meshes with the eighth gear 308. When the operation handle 303 is operated, the ninth gear 305 is brought into mesh with the sixth gear 304 while it keeps its mesh with the eighth gear 308. That is, the eighth gear 308 is interlocked with the sixth gear 304. The ninth gear 306 meshes with the seventh gear 307. When the operation handle 303 is operated, the ninth gear 306 is brought into mesh with the sixth gear 304 while it keeps its mesh with the seventh gear 307. That is, the seventh gear 307 is interlocked with the sixth gear 304.

The operation arms 309*a* and 309*b* and the operation handle 303 are connected via the rotary shaft of the seventh gear 307 and the eighth gear 308. The operation handle 203 is able to freely rotate about the rotary shafts of the seventh gear 307 and the eighth gear 308. The operation arms 309*a* and 309*b* are connected to the operation handle 303 at their base end portions and support the ninth gears 305 and 306 at their leading ends. Specifically, the leading end portion of the operation arm 309*a* supports the ninth gear 305 and the leading end portion of the operation arm 309*b* supports the ninth gear 306.

The operation arms 309*a* and 309*b* are configured in such a manner that the ninth gears 305 and 306 start swinging with the turning of the operation handle 303. Specifically, when the operation handle 303 is turned in a first direction (the direction of A1 in FIG. 3B), the ninth gear 305 is enabled to mesh with the sixth gear 304 and the eighth gear 308 and as a result the sixth gear 304 and the eighth gear 308 are interlocked. Meanwhile, when the operation handle 303 is turned in a second direction (the direction of A2 in FIG. 3B), the ninth gear 306 is enabled to mesh with the sixth gear 304 and the seventh gear 307 and as a result the sixth gear 304 and the seventh gear 307 are interlocked.

Since the actuator 400 is connected to the operation handle 303, the operation handle 303 can be turned in the first direction A1 or the second direction A2 by the actuator 400. The detection sensor 402 detects the collapse amount of the retard roller 103. In the present embodiment, as illustrated in FIG. 4, the detection sensor 402 is disposed between a unit frame 401 and the roller shaft 103*b* of the retard roller 103 to detect the distance between the unit frame 401 and the roller shaft 103*b*. When the distance becomes a predetermined value, the actuator 400 is driven by a controller (not illustrated), thereby turning the operation handle 303 in the first direction A1 or the second direction A2.

Figure 5:
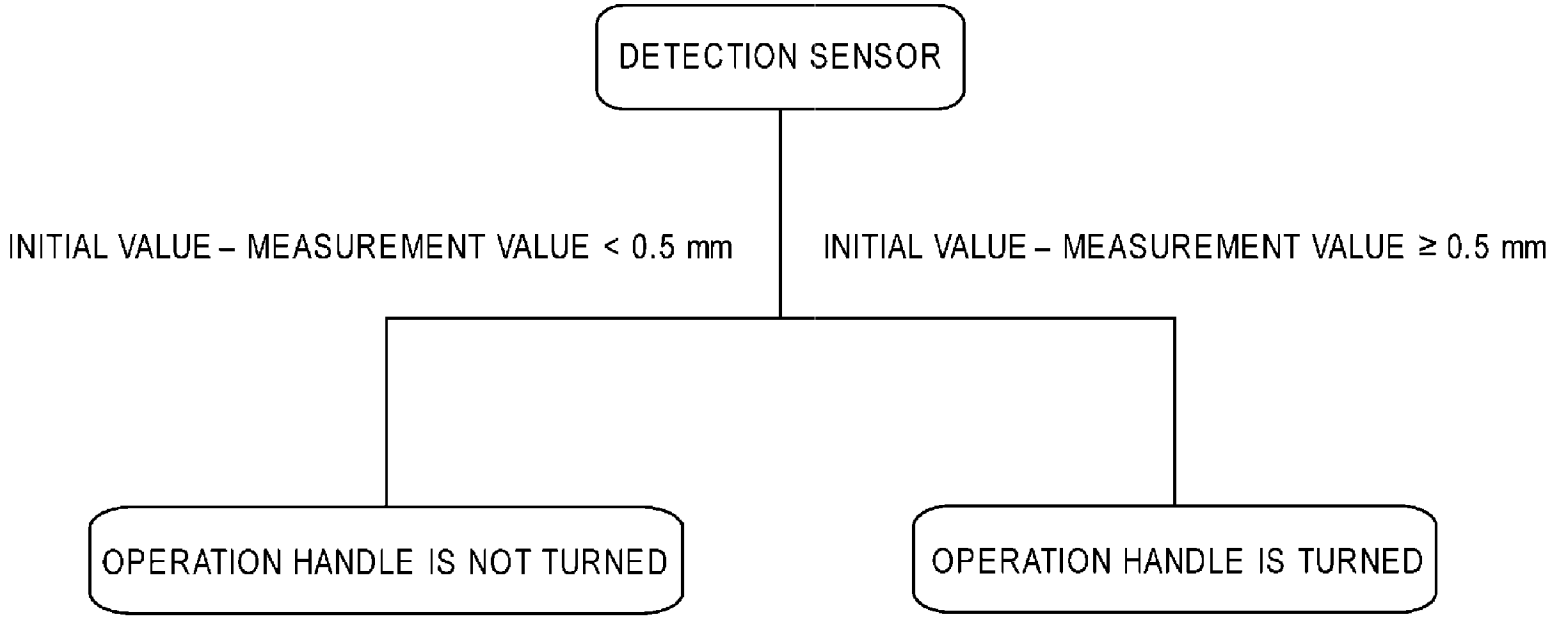
FIG. 5 is a diagram illustrating operation of an operation handle which is controlled based on the detection result from the detection sensor according to the second exemplary embodiment.

Next, the control operation that the controller operates the operation handle 303 will be described with reference to FIG. 5. FIG. 5 is a diagram illustrating the operation of the operation handle 303 controlled based on the detection result from the detection sensor 402 according to the second embodiment.

Since the collapse amount of the retard roller 103 is small under initial conditions, it is not necessary to change the gear to turn in a direction to reduce the magnitude of the rotary torque. Accordingly, under the initial conditions, the ninth gear 305 is in mesh with the sixth gear 304 and the eighth gear 308 so that the sixth gear 304 is interlocked with the eighth gear 308. That is, the controller performs control of turning the operation handle 303 in the first direction A1 by operating the actuator 400 in order to cause the sixth gear 304 to be interlocked with the eighth gear 308. This state is maintained under the initial conditions.

Next, as illustrated in FIG. 5, when the value obtained by subtracting a measurement value, which the detection sensor 402 measured, from the initial value (a predetermined value which was measured beforehand) reaches or exceeds 0.5 (mm) (becomes a predetermined value or more), the controller performs control of turning the operation handle 303 in a direction by operating the actuator 400. In other words, the controller turns the operation handle 303 in the second direction A2 so that the sixth gear 304 is interlocked with the seventh gear 307, and thereby the ninth gear 306 is enabled to mesh with the sixth gear 304 and the seventh gear 307. In this way, the gear is changed in a direction to reduce the rotary torque.

For example, it is assumed to use a retard roller 103 which has a diameter of 16 (mm) originally and collapses into 13.2 (mm) in diameter when it is pressed by the feed roller 102. For this instance, if the diameter of the retard roller 103 becomes smaller than 12.7 (mm) in a pressed state, the controller operates the actuator 400 to turn the operation handle 303 in the second direction A2.

For this instance, in a case where the rotary torque transferred to the retard roller 103 is 400 (gf·cm) under the initial conditions, if the collapse amount of the retard roller 103 increases by 0.5 (mm), the rotary torque becomes 360 (gf·cm). Since an appropriate range of the rotary torque is 370 to 430 (gf·cm) under the initial conditions, in the above case in which the rotary torque is kept within the range of 335 to 390 (gf·cm) while the collapse amount of the retard roller 103 increases by 0.5 (mm), it can be said that the adjustment can be suitably performed. Further, the change in the change gear ratio generally leads to a change in the return speed of the retard roller 103. However, within the teeth number ratio range in the present embodiment, the change in the change gear ratio does not nearly affect the return speed of the retard roller 103.

The image forming apparatus 1A including the sheet feeding portion 2A according to the second embodiment which has the above-described structure demonstrates the following effects as well as the effects of the first embodiment. The sheet feeding portion 2A according to the second embodiment includes the detection sensor 402 which detects the collapse amount of the retard roller 103, the actuator 400 which drives the operation handle 303, and the controller which operates the actuator 400. Accordingly, the rotary torque can be changed via the controller. In this way, the rotary torque can be changed without the operator's intervention (service person's or user's intervention) of operating the operation handle. This, for example, reduces the incidence of maintenance, and hence results in the reduction of maintenance costs such as cost for replacement.

Hereinabove, the embodiments of the invention are described. However, the present invention is not limited to the embodiments described above. The effects described in the embodiments of the present invention are representatives of the most preferable effects produced by the invention, and the effects of the invention are not limited to the effects described in the embodiments of the invention.

For example, in the present embodiments, the torque changing unit is configured such that a plurality of gears meshes with one another to change the change gear ratio between the output shaft 202*a* and the roller shaft 103*b* in multiple stages. However, the torque changing unit in the present invention is not limited this structure. The torque changing unit may be configured in such a manner that a running speed is changed in many stages by using a timing belt, for example.

In the present embodiment, the detection sensor 402 is disposed between the unit frame 401 and the roller shaft 103*b* of the retard roller 103 to detect the distance between the unit frame 401 and the roller shaft 103*b*, but the present invention is not limited thereto. The detection sensor may be disposed at any location as long as it can determine the collapse amount of the retard roller 103. For example, the detection sensor 402 may be configured such that it detects the distance between the roller shaft 103*b* of the retard roller 103 and the rotary shaft of the feed roller 102 and determines the collapse amount based on the detected distance. Alternatively, the detection sensor 402 may determine the collapse amount of the retard roller 103 based on the distance between the roller shaft 103*b* of the retard roller 103 and output shaft 202*a* of the torque limiter 202.

In addition, in the first embodiment, the rotary torque is changed in such a way that an operator operates the operation handle 203 based on the number of conveyed sheets S, but the present invention is not limited thereto. For example, the magnitude of the rotary torque may be changed in such a way that an operator operates the operation handle 203 based on the operation time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-281478, filed Dec. 17, 2010, which is hereby incorporated by reference herein in its entirety.

What is claimed is:

1. A sheet feeding device comprising:

a feed roller which rotates in a sheet feed direction;

a separation roller which is able to rotate in a reverse direction to the sheet feed direction, which is configured to separate sheets one by one between the feed roller and the separation roller;

a torque limiter which is interposed between a drive shaft driven to rotate by a drive source and a roller shaft of the separation roller to transfer a predetermined torque of the reverse direction to the separation roller; and a torque changing unit which is interposed between an output shaft of the torque limiter and the roller shaft of the separation roller to change the magnitude of a torque transferred to the separation roller.

2. The sheet feeding device according to claim 1, wherein the output shaft of the torque limiter and the roller shaft of the separation roller are arranged to be parallel to each other, and the torque changing unit is a speed changing device which changes a change gear ratio between the output shaft and the roller shaft in multiple stages.

3. The sheet feeding device according to claim 1, wherein the torque changing unit includes a drive gear attached to the output shaft of the torque limiter, a plurality of driven gears, which is attached to the roller shaft of the separation roller and have different numbers of teeth, an intermediate gear which interlocks the drive gear with any one of the plurality of driven gears, and an operation handle that operates the intermediate gear.

4. The sheet feeding device according to claim 1, further comprising:

a detection portion which detects a collapse amount of the separation roller; and an operation unit that changes the torque changing unit in a direction to reduce the predetermined torque transferred to the separation roller in a case where the collapse amount of the separation roller detected by the detection portion reaches or exceeds a predetermined value.

5. An image forming apparatus including an image forming portion which forms an image on a sheet supplied from a sheet feeding device, the sheet feeding device comprising:

a feed roller which rotates in a sheet feed direction;

a separation roller which is able to rotate in a reverse direction to the sheet feed direction, which is configured to separate sheets one by one between the feed roller and the separation roller;

a torque limiter which is interposed between a drive shaft driven to rotate by a drive source and a roller shaft of the separation roller to transfer a predetermined torque of the reverse direction to the separation roller; and a torque changing unit which is interposed between an output shaft of the torque limiter and the roller shaft of the separation roller to change a magnitude of a torque transferred to the separation roller.

6. The image forming apparatus according to claim 5, wherein the output shaft of the torque limiter and the roller shaft of the separation roller are arranged to be parallel to each other, and the torque changing unit is a speed changing device which changes a change gear ratio between the output shaft and the roller shaft in multiple stages.

7. The image forming apparatus according to claim 5, wherein the torque changing unit includes a drive gear attached to the output shaft of the torque limiter, a plurality of driven gears, which is attached to the roller shaft of the separation roller and has different numbers of teeth, an intermediate gear which interlocks the drive gear with any one of the plurality of driven gears, and an operation handle that operates the intermediate gear.

8. The image forming apparatus according to claim 5, further comprising:

a detection portion which detects a collapse amount of the separation roller; and an operation unit that changes the torque changing unit in a direction to reduce the predetermined torque transferred to the separation roller in a case where the collapse amount of the separation roller detected by the detection portion reaches or exceeds a predetermined value.

* * * * *